United States Patent [19]

Bettanini et al.

[11] 4,238,223

[45] Dec. 9, 1980

[54] METHOD OF EXTRACTING MAGNESIUM FROM MAGNESIUM OXIDES

[75] Inventors: Carlo Bettanini; Stelio Zanier; Margherita Enrici, all of Bolzano, Italy

[73] Assignee: Societa Italiana per Il Magnesio E Leghe Di Magnesio S.p.A., Balzano, Italy

[21] Appl. No.: 51,835

[22] Filed: Jun. 25, 1979

[51] Int. Cl.[3] ..... C22B 45/00

[52] U.S. Cl. ..... 75/10 R; 75/67 R

[58] Field of Search ..... 75/67 R, 10 R, 27

[56] References Cited

U.S. PATENT DOCUMENTS

| | | | |
|---|---|---|---|
| 1,379,886 | 5/1921 | Waldo | 75/67 R |
| 3,343,921 | 9/1967 | Braur | 75/10 R |

*Primary Examiner*—M. J. Andrews

*Attorney, Agent, or Firm*—Larson, Taylor and Hinds

[57] ABSTRACT

A process for extracting magnesium from compounds containing magnesium oxides is disclosed. The process is carried out at lower temperatures and pressures than previous processes which does not melt the dross. The process comprises the steps of mixing magnesium oxide and calcium oxide with aluminum, compressing the mixture, heating the compressed mixture uniformally to a temperature in the range of 800°–1100° C. under controlled pressure to vaporize the magnesium, and condensing the vaporized magnesium on a cooled surface.

12 Claims, 4 Drawing Figures

METHOD OF EXTRACTING MAGNESIUM FROM MAGNESIUM OXIDES

This invention relates to the extraction of magnesium from magnesium oxides. More particularly, the invention relates to a process for extracting magnesium from compounds containing magnesium oxides.

One of the main sources of magnesium metal produced on an industrial scale is dolomite which is a carbonate of calcium and magnesium. The magnesium metal is produced using a reduction process and in the past silicon or ferrosilicon has been the reducing agent. This process is known as the Pidgeon process. In the case when the starting material is calcined dolomite the following reaction occurs:

$$2(CaO.\ MgO)+Si=2\ Mg+(CaO)_2SiO_2 \quad (A)$$

According to this process the magnesium metal is liberated from the intimate mixture in the vapor state leaving a bi-calcium silicate as a dross.

In the past, this type of operation has been carried out at reduced pressure and with furnace temperatures up to about 1500° C., and at these temperatures the dross is in a molten state at the end of the reduction step. Thus, the starting material must be contained in a crucible or other container to prevent the liquid dross from spreading over the floor of the furnace. Furthermore, these high temperatures lead to high maintenance costs of the furnaces due to the frequent need to change the refractory linings which have only a limited life at these temperatures. Examples of these processes are described by Van Embden in U.S. Pat. No. 2,252,052 Cooper in U.S. Pat. No. 2,429,668 and Artru and Marchal in French Patent No. 762,671. The process defined in this French Patent requires the addition of a third component, alumina, to act as a melting medium but does not take any part in the chemical action defined in formula (A).

Furthermore, with the high temperatures of the known processes of producing magnesium metal, a high degree of contamination occurs because as well as magnesium other metals are also vaporized and subsequently condensed in the reduction process. These other metals are present as impurities in the magnesium oxide and include for example, calcium, lead, antimony, manganese, nickel, silicon, tin, copper, iron and others.

The problem of high temperatures can be overcome in part by making use of the silicothermic process in the solid state. Unlike known methods this process does not require high temperatures, thus the dross does not become molten and can be extracted from the furnace in the solid state. In this process an intimate mixture of fine powders is prepared and compacted or compressed into blocks consisting of calcined dolomite and a reducing agent and it is possible to achieve distillation of the magnesium whilst limiting the temperatures of the reaction to below the melting point of the blocks. By achieving this lower temperature, the degree of contamination is considerably reduced.

It is one purpose of the present invention to provide a process which can be carried out at temperatures below the melting point of the starting materials and this is achieved in part by replacing the silicon either in whole or in part with aluminum.

As well as the reaction identified as formula (A), other possible chemical reactions include the following formulas involving dolomite, magnesium oxide and aluminum:

$$3(CaO.\ MgO)+2Al=3Mg+(CaO)_3Al_2O_3 \quad (B)$$

$$8(CaO.\ MgO)+4MgO+8Al=12Mg+(CaO)_3Al_2O_3+(CaO)_5(Al_2O_3)_3 \quad (C)$$

$$5(CaO.\ MgO)+4MgO+6Al=9Mg+(CaO)_5(Al_2O_3)_3 \quad (D)$$

$$5(CaO.\ MgO)+2Al+Si=5Mg+(CaO)_3Al_2O_3+(CaO)_2SiO_2 \quad (E)$$

$$17(CaO.\ MgO)+4MgO+6Al+6Si=21Mg+(CaO)_5(Al_2O_3)_3+6(CaO)_2SiO_2 \quad (F)$$

The (E) and (F) formulas represent reactions when dolomite, magnesium oxide and a mixture of two reducing agents, silicon and aluminum are used. The dolomite may be replaced by a mixture of calcium oxide and magnesium oxide from any source provided the proportions of the mixture of oxides correspond to the stoichiometric ratio of dolomite.

The process of the present invention is carried out by first taking a measured amount of powdered aluminum, and in some cases the addition of ferrosilicon, magnesium oxide and calcium oxide, mixing these powders together and compressing them into a block for reduction by means of heating in a furnace under controlled pressure. The heating need not exceed 1100° C. and is preferably in the range of 800°–1100° C. Under these temperature conditions and at a controlled pressure, the magnesium metal vaporizes and is recovered by condensation leaving behind an exhausted dross in the solid state consisting of a particular calcium aluminate or more generally a stoichiometric equivalent mixture of other aluminates. If a mixture of two reducing agents is used, the dross contains calcium silicate and calcium aluminate. If the two reducing agents are used under the working conditions according to the present invention, the agents work together in a synegistic manner.

In the past this process was not feasible due to the scarcity of the required raw materials. However, in recent years there has been a demand for a magnesium oxide and calcium oxide of a high purity and these have been obtained using calcination of the respective carbonates or making use of precipitation processes followed by subsequent drying of the corresponding oxides. Furthermore, aluminum in granular form or chip form is now available in large quantities from a machining process or from scrap.

This alumino-thermic process carried out in the solid state has a number of advantages over known processes of recovering magnesium metal. One advantage is that, due to the lower reaction temperature, it is possible to produce a much purer magnesium metal because the lower temperatures avoid the distillation of other metals in the magnesium metal. Furthermore, it has been found that a greater magnesium content may be used in the starting mix, thus resulting in a higher output of magnesium from a single furnace. Still further, by keeping the temperature below 1100° C. there is less wear in the reaction furnace which tends to keep operating and maintenance costs down.

The present invention provides a process of extracting magnesium from compounds containing magnesium oxides comprising the steps of mixing magnesium oxides and calcium oxide with aluminum, and in some cases ferrosilicon, compressing the mixture, heating the compressed mixture uniformally to a temperature in the range of 800°–1100° C., under a controlled pressure to vaporize magnesium, and condensing the vaporized magnesium on a cooled surface.

In a preferred embodiment the proportion by weight of the various components of the mixture should correspond to the stoichiometric ratio and preferably the mixture contains 2.0–2.5 parts by weight magnesium oxide, 1.5–2.0 parts by weight calcium oxide and 1.0–1.5 parts by weight aluminum. The compounds should preferably be in powder or granular form before mixing. In one embodiment the mixture is compacted into a block which may then be heated uniformally so that the temperature difference across the block does not exceed 100° C. In still another embodiment the block is formed integral with an electrical heating conductor and in yet a further embodiment the block is formed as a hollow column with the heating conductor formed as a helical coil within the block.

In a preferred embodiment the process is carried out in a lower portion of an electric furnace, the lower portion having an insulated lining and the block being spaced from the lining. An upper portion forms the cooled surface for condensing the magnesium metal thereon and is joined to the lower portion to form an enclosed sealed chamber. The pressure may be controlled by an exhaust pump and a filter prevents vaporized magnesium from passing through to the pump. Separate condensation chambers, which are removable, may be provided, each condensation chamber having a cooled surface therein.

In drawings which illustrate embodiments of the invention,

Figure 1:
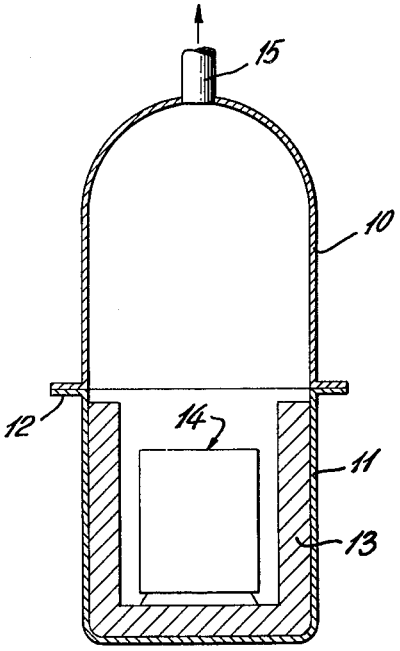
FIG. 1 is a diagrammatic cross sectional view through one embodiment of an electric furnace suitable for the process of the present invention.
Figure 2:
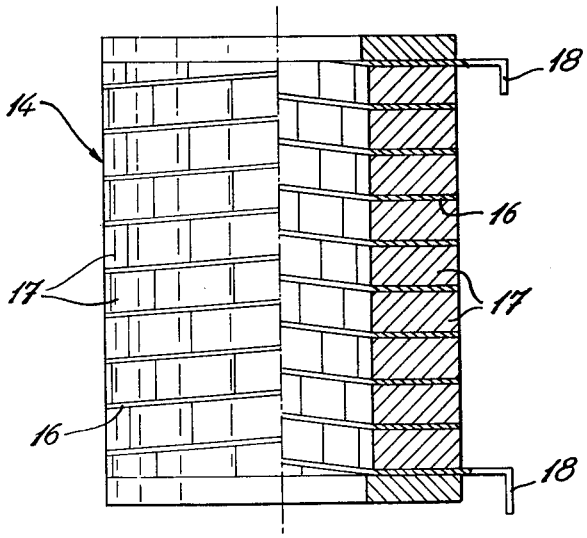
FIG. 2 is a side view, partly in cross section, of an electrical heating conductor together with the compounds in a solid compressed form shaped as a hollow column structure for insertion in the electric furnace shown in FIG. 1.

FIGS. 1 and 2 illustrate an electric furnace suitable for the process of this invention. The furnace has a top bell-shaped portion 10 and a lower cylindrical portion 11 which define a substantially cylindrical chamber. The top and lower portions 10 and 11 are joined together in a detachable manner at flange 12 to form a sealed chamber, the joint 12 being provided with a suitable seal in order to maintain the sealed chamber. The lower portion 11 is lined internally with refractory material 13 and constitutes the heating chamber or reduction chamber of the furnace. A block or charge 14 of the compounds to be heated are placed in the lower portion 11 spaced apart from the refractory lining 13 so that as the metal in the charge vaporizes due to heat the vapor can escape from the sides as well as the top of the charge 14.

The top portion 10 is provided with a suitable cooling means (not shown). The top portion 10 constitutes the condensation chamber for the magnesium vapors which are set free during the course of the reduction from the charge 14. The top portion 10 and the lower portion 11 are both made from suitable material preferably metal which has suitable strength to withstand the mechanical and thermal stresses to which the furnace is subjected. A controlled pressure is maintained within the sealed chamber by means of a suitable suction through a conduit 15 preferably connected to an exhaust pump. A pressure sensing device may be included in the sealed chamber, and in a preferred embodiment a filter is supplied on this exhaust conduit 15 to prevent metallic vapors passing to the exhaust pump.

The charge 14 is shown in more detail in FIG. 2 and is constructed in the form of a hollow column. The structure of electrical conducting elements 16 are formed in a helix and the mass of compounds are compacted or compressed in spaces 17 between the helical elements 16 which are suitably connected at their terminals 18 to electrical connections provided within the furnace. The charge 14 is then heated by electrical resistance to the desired temperature, and the conductor elements 16 maintain a uniform temperature throughout the charge 14. The preparation of the charge 14 takes place outside the furnace wherein the mixture of compounds is first prepared and then compacted between these elements 16 prior to installation in the furnace. In the embodiment shown the charge 14 has electrical conductor elements 16 in the form of a helical coil. It will be apparent to those skilled in the art that other configurations of electrical conductor elements could also be employed in the charge, such conductor elements could take almost any shape provided the mass of the charge was evenly heated. For example, conductor elements may be installed within the hollow column as shown in FIG. 2.

In operation powders of magnesium oxide, calcium oxide and aluminum and in some cases ferrosilicon in powder or granule form are mixed together according to the following weight ratios, Magnesium oxide: 2.0–2.5 parts by weight
Calcium oxide: 1.5–2.0 parts by weight
Aluminum: 1.0–1.5 l parts by weight

After mixing, these compounds are compacted or compressed to a charge 14 such as that shown in FIG. 2. The mixture is compressed within the conductor elements 16 so that the compounds are evenly compressed and form a column or self sustaining mass that retains its shape when left. In this form the charge 14 is placed within the furnace, the terminals 18 connected to the terminals within the furnace, the top portion 10 of the furnace located on and sealed to the flange 12, and gases are drawn through conduit 15 inside the sealed chamber. The conductor elements 16 commence heating the block evenly and the temperature of the block increases to within the range of 800°–1100° C. At this temperature, the temperature range through the block does not exceed 100° C. At this temperature the magnesium vaporizes and commences to be set free from the charge 14, these vapors exit from the outside and the inside of the column structure and also on top of the column, the vapors pass upwards from the hot lower portion of the furnace into the top portion 10 where they condense against the cooled surface of the top portion 10. The condensed magnesium metal forms crystals on these cooled surfaces, and this process continues while the temperature of the block is maintained at between 800° and 1100° C. until all the magnesium metal has been released from the block and condensed in the cooled surface. After a pre-set time the power to the conductor elements 16 is turned off to allow the furnace to commence cooling, and the exhaust pump is stopped. Before the furnace is cooled, the top portion 10 is removed and the hot charge 14, which has still retained its structure because the highest temperature reached was below the melting temperature, is removed from the furnace and replaced with a new charge 14. At the same time, the magnesium crystals are scraped off the inside surface of the top portion 10 which is then replaced on top of the lower portion 11, the flange 12 connected and the process recommenced.

Figure 3:
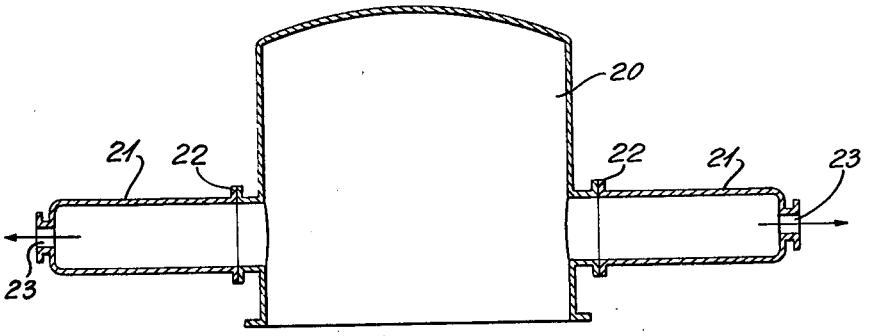
FIG. 3 is a diagrammatic cross sectional view through another embodiment of an electric furnace having at least one separate condensation chamber.
Figure 4:
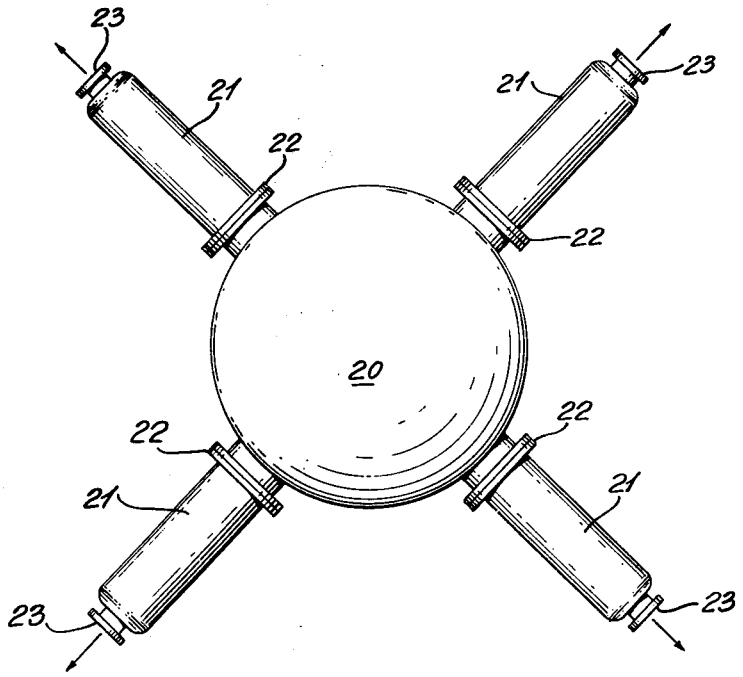
FIG. 4 is a top plan view of the electric furnace shown in FIG. 3.

FIGS. 3 and 4 show another embodiment of the furnace in which a top portion 20 has four condensation chambers 21 spaced around the periphery of the top portion 20. These condensation chambers 21 are joined to the top portion 20 by flanges 22 and each chamber 21 has an exhaust conduit 23 at the far end to suck the metallic vapors into the condensation chambers 21. Each of the condensation chambers 21 has cooling means surrounding it so that the magnesium metal condenses on the walls of the chambers 21. After the chambers 21 have become full, then it is merely necessary to uncouple the flanges 22, take off the chambers 21, and replace them with new chambers 21. In this way less down time is needed, and the scraping may be carried out when the condensation chambers 21 are separated from the furnace.

Tests carried out using the apparatus illustrated in FIGS. 1 and 2 have shown that as much as 25% by weight of the charge mixture of magnesium has been recovered from each batch.

The following table summarizes the results of tests carried out on the extraction of magnesium from different components. The results confirm the recovery percentages achieved with this process. The mixtures used in these tests correspond to the proportions to comply with the formulas A to F.

TABLE

| | CONSUMPTION OF RAW MATERIALS PER TON OF MAGNESIUM OBTAINED | | | | | |
|---|---|---|---|---|---|---|
| | COMPONENTS (Tons) | | | | | |
| FORMULA | Dolomite or an equivalent stoichiometric mixture of CaO + MgO | MgO of any origin | Ferrosilicon, title 78B,Si | Aluminum, title 94B,Al | Aluminum, title, 60B,Al | TOTAL CONSUMPTION (Tons) |
| A | 5.00 | — | 0.90 | — | — | 5.90 |
| B | 4.50 | — | — | 0.84 | — | 5.34 |
| C | 3.03 | 0.65 | — | 0.87 | — | 4.55 |
| $D_1$ | 2.38 | 0.91 | — | 0.81 | — | 4.10 |
| $D_2$ | 2.74 | 0.93 | — | — | 1.45 | 5.12 |
| E | 4.75 | — | 0.34 | 0.53 | — | 5.62 |
| F | 3.94 | 0.39 | 0.49 | 0.39 | — | 5.21 |

Charges as high as one metric ton have been processed and furthermore it has been found that the energy required is in the order of 1,800 kilowatts for the complete reduction of one metric ton based on the recovery of 25% by weight of magnesium from each charge.

The embodiments of the invention in which an exclusive property or privilege is claimed are defined as follows:

1. A process of extracting magnesium from compounds containing magnesium oxides comprising the steps of mixing magnesium oxide and calcium oxide with aluminum, compressing the mixture, heating the compressed mixture uniformly to a temperature in the range of 800°-1,100° C. under controlled pressure below atmospheric pressure to vaporize the magnesium, and condensing the vaporized magnesium on a cooled surface.

2. The process according to claim 1 wherein the mixture contains 2.0-2.5 parts by weight magnesium oxide, 1.5-2.0 parts by weight calcium oxide, and 1.0-1.5 parts by weight aluminum, and the mixing occurs with the compounds in powder form.

3. The process according to claim 1, wherein magnesium oxide and calcium oxide are mixed with aluminum and ferrosilicon.

4. The process according to claim 3, wherein the mixture contains 2.0-2.5 parts by weight magnesium oxide, 1.5-2.0 parts by weight calcium oxide and 1.0-1.5 parts by weight aluminum and ferrosilicon, and the mixing occurs with the compounds in powder form.

5. The process according to claim 1 or claim 3 wherein the mixture is compacted into a block, and wherein the block is heated uniformally so that temperature differences across the block do not exceed 100° C.

6. The process according to claim 5 wherein the block is formed integral with an electrical heating conductor.

7. The process according to claim 6 wherein the block is formed as a hollow column and wherein the heating conductor is formed as a helical coil within the block.

8. The process according to claim 6 wherein the block is formed of a plurality of rings and wherein the heating elements forming the electrical heating conductor are positioned between the rings.

9. The process according to claim 6 wherein the block is placed in a lower heating portion of an electrical furnace, the lower portion having an insulated lining, the block being spaced from the lining, and a top portion forming the cooled surface is joined to the lower portion to form an enclosed sealed chamber.

10. The process according to claim 1 or claim 3 wherein the controlled pressure is maintained by an exhaust pump and a filter prevents vaporized magnesium from passing into the pump.

11. The process according to claim 1 or claim 3 including removable condensation chambers each having the cooled surface therein.

12. The process according to claim 6 wherein the block is extracted from the furnace after the heating step and whilst still hot and replaced with a fresh block.

* * * * *